United States Patent [19]

Doherty, Jr.

[11] 4,414,524

[45] Nov. 8, 1983

[54] THERMALLY RESPONSIVE SWITCH

[75] Inventor: John Doherty, Jr., Assonet, Mass.

[73] Assignee: Texas Instruments Incorporated, Dallas, Tex.

[21] Appl. No.: 328,279

[22] Filed: Dec. 7, 1981

[51] Int. Cl.[3] ..... H01H 61/00

[52] U.S. Cl. ..... 337/87; 337/340; 337/364

[58] Field of Search ..... 337/87, 89, 340, 343, 337/364, 365, 370

[56] References Cited

U.S. PATENT DOCUMENTS

| | | | |
|---|---|---|---|
| 3,207,875 | 9/1965 | Bagnall et al. | 337/87 |
| 3,634,801 | 1/1972 | Gould et al. | 337/340 X |
| 4,092,624 | 5/1978 | Tomoyoshi | 337/340 |

*Primary Examiner*—George Harris

*Attorney, Agent, or Firm*—James P. McAndrews; John A. Haug; Melvin Sharp

[57] ABSTRACT

A thermally responsive switch is particularly adapted to perform a plurality of electrical control functions on an automotive engine in response to changes in engine temperature. The switch is characterized by a structure permitting the switch operating temperatures to be easily matched to the requirements of specific automotive applications. The switch mounts first electrical contacts on an insulating support and incorporates spring means mounted on a carrier, second contacts mounted on the spring means, and thermally responsive, snap-acting bimetallic discs or the like which are easily disposed between the respective spring means and the carrier to move the second contacts relative to the carrier in response to temperature change. The thermally responsive discs are easily retained on the carrier between the spring means and carrier to form a thermally responsive unit having selected thermal response characteristics and the carrier is easily mounted on the insulating support so that the second contacts move between open and closed circuit positions spaced from or engaging the first contacts on the support in response to selected temperature change.

11 Claims, 5 Drawing Figures

THERMALLY RESPONSIVE SWITCH

BACKGROUND OF THE INVENTION

The field of this invention is that of thermally responsive electrical switches and the invention relates more particularly to switches for performing electrical control functions on automotive engines in response to changes in engine temperature.

Controls for automotive engines have become increasingly more precise in attempting to improve fuel efficiency and reduce exhaust pollution emissions while maintaining suitable engine driveability and as a result there has been a growing need for low cost, thermally responsive controls which are rugged and reliable enough to perform control functions in an automobile environment in response to changes in engine temperature. Such controls are already being used in a wide variety of applications to provide temperature-indicating electrical signals to microprocessor-based engine control units and for regulating exhaust gas recirculation and distributor advance and the like through thermal valve regulation of vacuum lines. Such known controls also include controls providing direct regulation for individually operated electrical devices such as engine cooling fans and the like and more recently it has been found desirable to provide two speed regulation of engine cooling fans and/or regulation of two separate engine cooling fans so that, for example, one fan is operated under normal engine running conditions and the second is activated during overheating situations when the vehicle is standing in traffic or the like.

Many of such previously known thermally responsive automotive controls have been characterized by sturdy, low cost structures. Many have had a thermally and/or electrically conductive metal housing part secured to a molded housing part of an organic, electrically insulating material to form a chamber therebetween and such controls have incorporated one or more thermally responsive bimetallic members in the control chamber for providing desired control functions. However, the cost of making such control devices is very volume dependent and although control devices of the same general type find wide application it is frequently found that the devices require different operating conditions for serving various segments of the market. As a result, significant manufacturing costs are encountered in assembling devices to meet those individual temperature requirements. It has also been difficult to meet delivery schedules where determination of device operating temperatures are delayed or changed at the last moment.

SUMMARY OF THE INVENTION

It is an object of this invention to provide a novel and improved thermally responsive electrical switch; to provide such a switch which is characterized by a sturdy low cost structure; to provide such a switch which is adapted to be easily assembled at low cost to provide any of a very wide range of operating temperatures; to provide such switches in which low-cost, mass-produced components are adapted to be easily and economically put together to form conveniently handled subassemblies having selected, different temperature response characteristics; to provide such switches in which subassemblies are easily joined together when required to provide small volumes of switches at low cost; to provide such switches which are adapted to perform a plurality of thermally responsive control functions at different temperatures; and to provide such switches having structures in which selected assembly procedures are adapted to be performed using large volume assembly techniques.

Briefly described, the novel and improved thermally responsive electrical switch or control device of this invention comprises electrically insulating support means having one or more first contacts mounted thereon. The switch also includes a carrier having spring means mounted on the carrier, having second contacts mounted on the spring means, and having thermally responsive means mounted on the carrier between the carrier and the spring means for moving the second contacts relative to the carrier in response to temperature change. The carrier and its associated components thus form a temperature responsive subassembly. The carrier is adapted to be mounted in the switch in a selected location relative to the insulating support so that the second contacts move between open and closed circuit positions spaced from or engaging the first contacts on the support means in response to the occurence of a selected temperature change.

In one preferred embodiment of the invention, the switch includes on open-ended cup-shaped metal housing part and the electrically insulating support means is mounted over the open end of the metal housing to form a control chamber therebetween. A pair of first contact terminals extend through the insulating support into the chamber in spaced electrically insulated relation to each other and to the metal housing and a carrier subassembly is mounted in the chamber. The carrier subassembly includes a carrier element having a central opening, a pair of electrically conductive spring blades each having one end secured to one end of the carrier so that the blades extend across respective opposite sides of the carrier opening and so that the opposite ends of the blades are biased toward each other at the opposite end of the carrier, second contacts mounted on the opposite ends of the spring blades, and a pair of dished, thermally-responsive bimetallic members which are disposed between the carrier and the respective spring blades at opposite sides of the carrier opening, the bimetallic members each being adapted to move with snap action from an original dished configuration to an inverted dished configuration at a selected temperature. The bimetallic members normally hold the spring blades away from the carrier so that the second contacts are held with a selected spacing from each other at the opposite end of the carrier. However, the bimetallic members permit the respective blades and the second contacts carried thereon to more sharply toward each other at the opposite end of the carrier when the bimetallic members snap to their inverted dished configurations at said selected temperatures.

The carrier subassembly is conveniently mounted in the control chamber of the device in the final assembly procedure by fitting the opposite end of the carrier into a groove in the insulating support so that the carrier subassembly is captured in the chamber between the support and the metal housing part. The subassembly structure is arranged so that when mounted in this manner, the spring blades carrying the second contacts are electrically engaged with the metal housing part to ground the second contacts and so that the second contacts are adapted to move between open and closed circuit positions spaced from or engaging the first terminal contacts on the support as the thermally responsive bimetallic members move between their dished configurations in response to temperature changes.

In that arrangement, the thermally responsive electrical switch of this invention is characterized by a sturdy low cost structure. First contact terminals are easily provided on the insulating support to meet the needs of individual control applications and carrier subassemblies are easily put together to display desired thermal response characteristics. Those components are then easily assembled with the metal housing part as required to meet the volume and temperature response requirements of individual control applications. Various modifications of the device are easily made where necessary to vary the normally open or normally closed switch configurations as provided by the devices and the temperature requirements are easily changed by substituting thermally responsive members in the carrier subassemblies just before final switch assembly without requiring any significant alteration in assembly characteristics of the control devices.

DESCRIPTION OF THE DRAWINGS

Other objects, advantages and details of the novel and improved thermally responsive switch of this invention appear in the following detailed description of preferred embodiments of the invention, the detailed description referring to the drawings in which.

DESCRIPTION OF THE PREFERRED EMBODIMENTS

Figure 1:
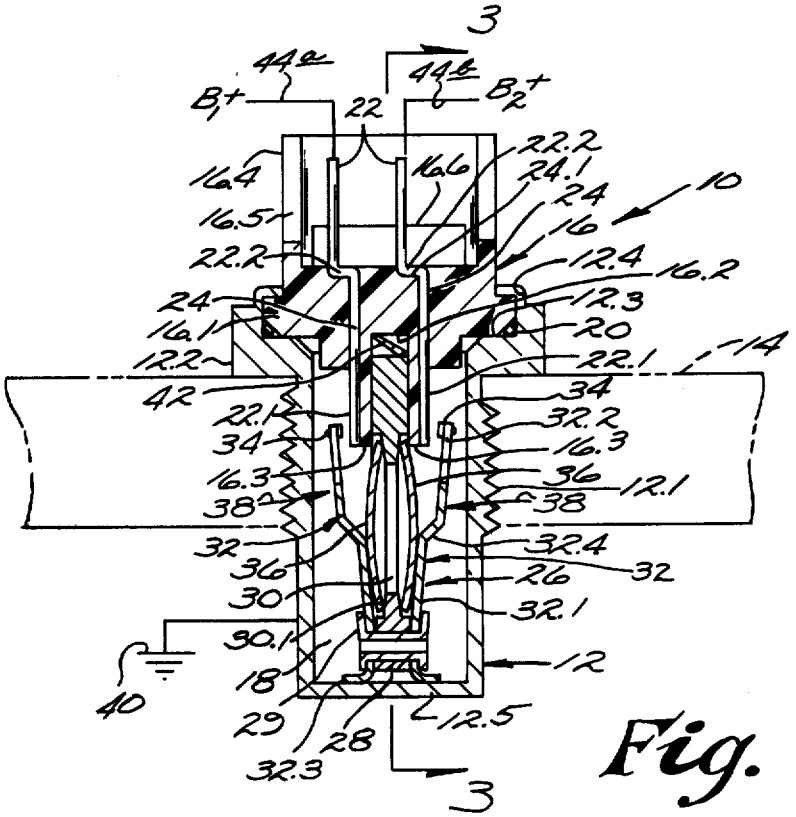
FIG. 1 is a section view along the principal axis of a preferrred embodiment of the switch of this invention.
Figure 2:
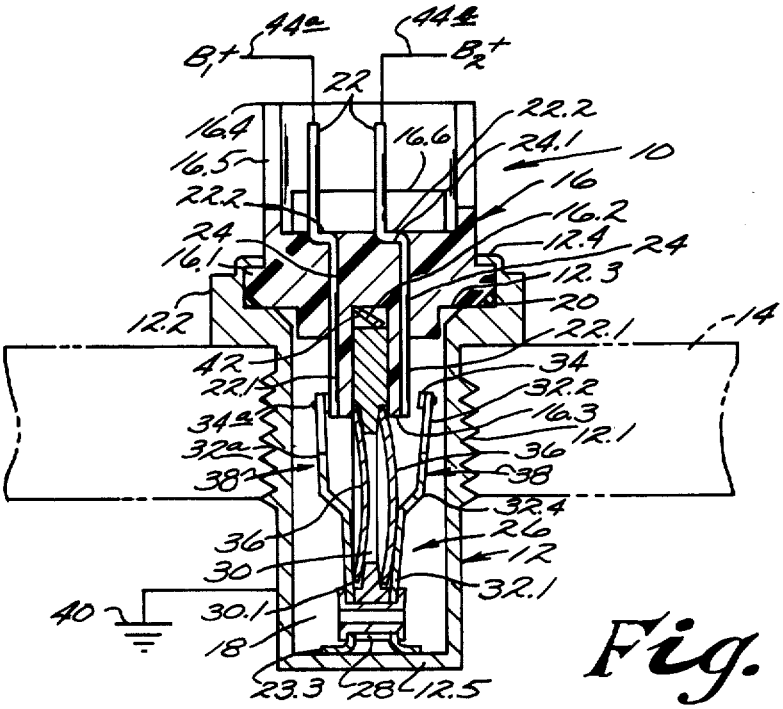
FIG. 2 is a section view similar to FIG. 1 illustrating an alternate position of the switch of FIG. 1.
Figure 3:
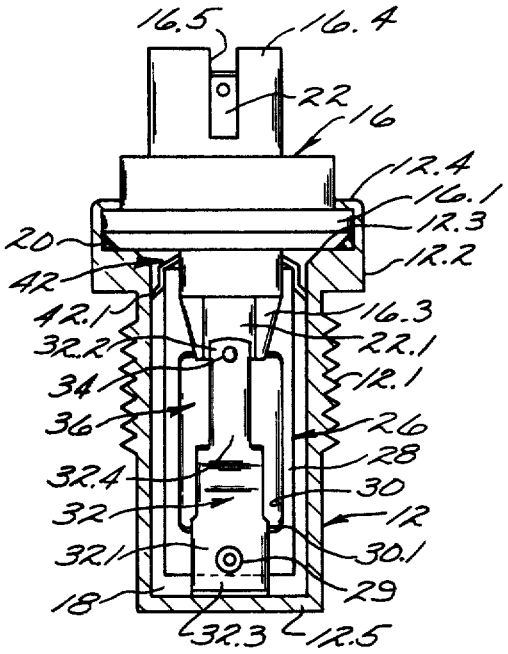
FIG. 3 is a section view along line 3—3 of FIG. 1.

Referring to the drawings, 10 in FIGS. 1–3 indicates a preferred embodiment of the novel and improved thermally responsive electrical switch of this invention which is shown to include a generally cylindrical thermally and electrically conducting metal housing part 12. The metal housing part preferably has the configuration of an open ended cup and preferably has external thread means 12.1 which serve to threadedly mount the control device 10 in close heat transfer relation to an automotive engine 14 or other object whose temperature is to be monitored. Preferably the housing 12 is formed of brass or the like and includes a portion 12.2 with a hexagonal outer configuration or the like for use in facilitating threaded mounting of the housing on the engine as will be understood. The housing also preferably includes a shoulder 12.3 and a rolled flange 12.4. The switch 10 further includes a support 16 of a strong, readily moldable electrically insulating material such as glass-filled nylon or the like. The insulating support preferably has a flange 16.1 rested on the shoulder 12.3 of the metal housing part and the flange 12.4 of the metal part is rolled over the flange 16.1 for securing the support and the metal housing together to form a control chamber 18 therebetween. Preferably, an O-ring gasket 20 or the like is compressed between the support and the metal housing part for sealing the control chamber. In the preferred embodiment of this invention, the electrically insulating support 16 has a groove 16.2 therein and has a pair of spacer parts 16.3 located on the respective opposite sides of the groove inside the chamber 18 as is shown particularly in FIG. 1. A pair of first electrically conductive contact terminals 22 extend through apertures 24 in the support so that the terminals are spaced in electrically insulated relation to each other and to the metal housing 12 by the support. The terminals extend from the interior of the chamber 18 to a location outside the control device 10. In accordance with this invention, the terminal apertures 24 are preferably located relative to the groove 16.2 so that contact portions 22.1 of the first contact terminals rest against the respective spacer parts 16.3 of the insulating support at opposite sides of the groove 16.2 as shown in FIG. 1.

The support 16 preferably has a guard or shield 16.4 molded therein to protect the first terminal extensions. The guard is preferably slit as indicated at 16.5 in FIG. 3 or is apertured as indicated at 16.6 in FIG. 1 to facilitate convenient and visible electrical connection to the terminals 22. If desired, the terminals are formed of stiff, low cost conductive material such as copper or steel having a nickel plating or the like to improve electrical contact characteristics. Preferably, the terminals have offsets 22.2 which mate with corresponding offsets 24.1 in the support apertures to facilitate locating of the terminals lengthwise in the support as will be understood. If desired, the terminals are press fitted into the support apertures to further seal chamber 18.

In accordance with this invention, a carrier subassembly 26 is disposed in the control chamber 18, the subassembly including a carrier element 28 formed of a stiff material such as aluminum or fiber-board or the like having a central opening or recess 30 therein. A shoulder 30.1 is preferably formed on the carrier around the recess at each side of the carrier as is best seen in FIG. 1. The subassembly also includes spring means 32 which are secured to the carrier, second contacts 34 which are mounted on the spring means, and thermally responsive members 36 which are disposed on the carrier between the carrier and the respective spring means. Preferably, for example, the spring means comprise a pair of electrically conductive, resilient spring blades 32 each of which is mounted at one end 32.1 to one end 28.1 of the carrier by a rivet 29. The second contacts 34 are secured to the opposite ends 32.2 of the spring blades. The blades extend over the carrier opening 30 at opposite sides of the carrier so that the opposite ends 32.2 of the blades are movable toward and away from each other and from the carrier near the opposite end 28.2 of the carrier. As indicated by the arrows 38 in FIG. 1, the spring blades normally bias the blades and the second contacts 34 to move toward the carrier. In one preferred embodiment of this invention, the electrically conductive spring blades have extensions 32.3 as shown particularly in FIG. 1.

In accordance with this invention, the thermally responsive members 36 are mounted in the carrier subassembly 26 between the carrier 28 and the respective spring blades 32. Preferably, the thermally responsive members each comprise a generally strip-shaped but dished thermally responsive bimetallic member (only one layer of the bimetallic member being shown for clarity of illustration). Each bimetallic member is adapted to move with snap action from an original dished configuration (as illustrated in FIG. 1) to an inverted dished configuration (as shown in FIG. 2) when the member is heated to a selected temperature.

Each dished member is disposed between the carrier and a respective spring blade 32, preferably with the margin of the member fitted against one of the shoulders 30.1 extending around the carrier opening, so that the member is retained in the subassembly over the opening by the blade but is free to move from its original dished configuration to its inverted dished configuration when the dished member is heated to its selected actuating or operating temperature. That is, each of the thermally responsive members is positioned on the carrier over the carrier opening so that the central domed part of the member is adapted to be accommodated in the recess when the member moves to its inverted dished configuration in response to temperature change.

In the embodiment of this invention as illustrated in FIGS. 1–3, the spring blades 32 are normally biased to move the second contacts 34 toward each other at the opposite end 28.2 of the carrier but the thermally responsive members engage the blades so that, when the members are in their original dished configuration, the second contacts are normally held at a substantial spacing from each other and from the opposite end 28.2 of the carrier. However, when the thermally responsive dished members move to their inverted dished configurations in response to temperature change, they permit the second contacts to move sharply towards the carrier end 28.2 in response to the bias of the spring blades 32. If desired, each of the spring blades has a central offset part 32.4 to facilitate engagement of the blade with a desired portion of its associated thermally responsive member 36 and to facilitate assembly and/or substitution of the member 36 in the subassembly 26 when desired. As thermally responsive dished members 36 are well known, they are not further described herein and it will be understood that they embody two or more layers of metal of different thermal expansion properties and are typically adapted to move with snap action from an original dished configuration to an inverted dished configuration when heated to one temperature and then to revert to their original dished configuration with snap action when the members are subsequently cooled to a second lower temperature. Typically, the two thermally responsive members 36 used in the switch 10 are adapted to be actuated at respective different operating temperatures. However, the thermally responsive members may be provided with the same operating temperatures for other applications within the scope of this invention.

In accordance with this invention, the carrier subassembly 26 is mounted in the control chamber 18 so that the second contacts 34 carried by the subassembly are adapted to move into and out of engagement with the respective first terminal contacts 22 on the support 16 for opening and closing electrical circuits in response to the occurrence of selected temperature changes. Preferably for example, the switch 10 is assembled by disposing the subassembly 26 within the control chamber 18 by fitting the end 28.2 of the carrier in the groove 16.2 of the insulating support so that the contacts 34 carried by the subassembly are disposed in selected spaced relation to the first terminal contacts 22 on the support. See FIG. 1. The flange 12.2 on the metal housing part is rolled over the support flange 16.1 for securing the housing parts together, thereby capturing the subassembly between the support 16 and the bottom 12.5 of the metal housing. In that arrangement, the extensions 32.3 on each of the electrically conductive spring blades are pressed into electrical engagement with the metal housing so that the second contacts 34 are each connected to electrical ground through the housing as is diagrammatically illustrated at 40 in FIG. 1. If desired, a U-shaped spring 42 is disposed in the groove 16.2 to assure that the blade extensions 32.3 are pressed into resilient engagement with the metal housing part 12 and, if desired, extensions 42.1 on the U-shaped spring can also facilitate locating and grounding the subassembly with respect to the metal housing part 12.

In that arrangement, the switch 10 is easily mounted on the engine 14 to securely mount the switch in close heat transfer relation to the engine. The dished thermally responsive members 36 are securely positioned in the switch chamber 18 to also be in close heat-transfer relation to the engine. The dished members normally hold the second contacts spaced from the first terminal contacts 22 so that circuits connected to separate engine cooling fans or the like as is diagrammatically illustrated at **44*a* and 44*b* in FIG. 1 are both in open circuit position. However, as the engine heats so that the switch member 36*a* (See FIG. 2) is heated to its actuating temperature, the member moves with snap action to its inverted dished configuration to close a circuit through the housing 12, a blade 32*a*, a second contact 34*a* and a terminal 22*a* as shown in FIG. 2, thereby to activate one of the engine cooling fans as indicated at 44*a*. If the engine should subsequently tend to overheat during standing in traffic or the like so that the second thermally responsive member 36 is heated to its relatively higher actuating temperature that member is adapted to close the second switch circuit 44*b* as will be understood. In that way, the switch 10 has a sturdy low cost structure which is adapted to close two circuits at two different temperatures. The switch is easily assembled using low cost components. Subassemblies 26** are easily put together to have desired thermal response characteristics and the subassemblies are easily joined with other switch components as required to provide small volumes of switches having desired thermal response characteristics. If necessary, thermally responsive members having different operating temperatures are easily substituted in the subassemblies before final assembly of the switches without requiring significant changes in other switch components. Assembly manufacturing set ups used in making switches with selected thermal properties do not require change merely because switches having other thermal properties are to be assembled.

Figure 4:
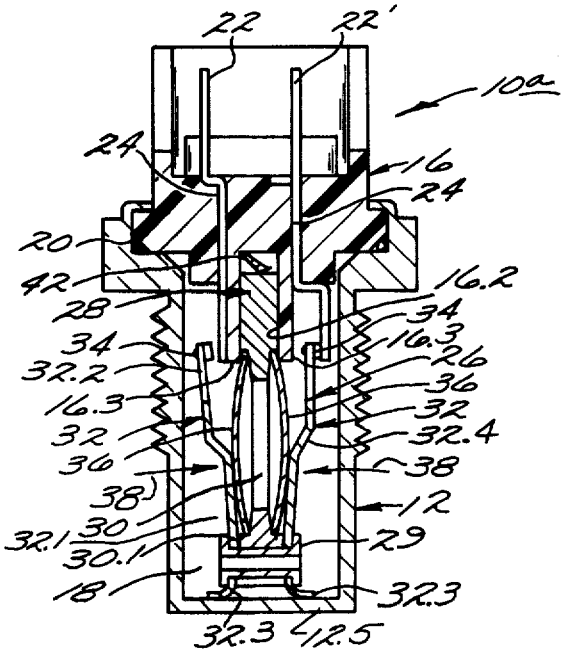
FIG. 4 is a section view similar to FIG. 1 illustrating one alternate embodiment of the switch of this invention.
Figure 5:
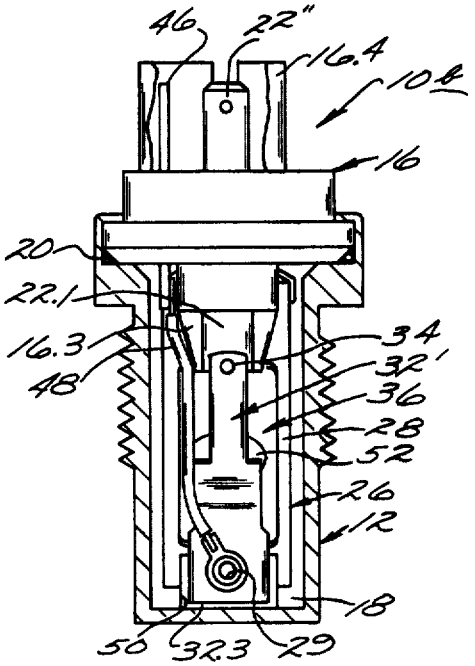
FIG. 5 is a section view similar to FIG. 3 illustrating another alternate embodiment of this invention.

If desired, switches having one or more normally closed contact pairs are also easily provided by minor change in terminal configuration or orientation as is illustrated in FIG. 4. That is, the switch **10*a* is easily provided with one normally closed contact pair by minor modification or reorientation of one of the first contact terminals 22' as shown in FIG. 4. Further, although the switch 10 is illustrated in FIGS. 1–3 as being adapted to close two separate circuits to the metal housing 12, many other switch configurations are also possible within the scope of this invention. For example, as is illustrated in FIG. 5, only minor modification of the switch 10 is required for changing the two normally open contact pairs of switch 10 to provide another switch type as indicated at 10*b*. Thus, an additional first terminal or contact 46 is easily provided in a drilled hole or the like in the support 16 and is electrically connected to one of the spring blades 32 by a wire lead 48 as shown in FIG. 5. Where that spring blade is insulated from the metal housing 12 by omitting the blade extension 32.3 and by use of an insulating spacer 50 and an insulating spacer film 52 coated on the associated thermally responsive member 36 (or by use of a carrier 28 formed of an insulating material), the switch 10*b* shown in FIG. 5 is easily adapted to close the circuit between the additional terminal 46 and one of the first contact terminals 22**″ on the occurrence of selected temperature change as will be understood.

Other modifications of the disclosed embodiments of the thermally responsive switch of this invention are possible within the scope of this invention and it will be understood that this invention includes all modifications and equivilents of the disclosed embodiments falling within the scope of the appended claims.

I claim:

1. A thermally responsive switch having electrically insulating support means, first contact means mounted on the support means, second contact means movable between an open circuit position spaced from the first contact means and a closed circuit position engaged with the first contact means, spring means biasing the second contact means to one of said circuit positions, and thermally responsive means moving the second contact means to the other circuit position against said bias on the occurrence of selected temperature conditions, characterized in that the spring means is secured to a carrier means, the second contact means are secured to the spring means, and the thermally responsive means is disposed between the carrier means and the spring means for moving the spring and second contact means relative to the carrier means in response to temperature change, the carrier means being mounted in selected location relative to the insulating support means so that the second contact means is moved from said one circuit position to the other circuit position as the second contact means moves relative to the carrier means in response to the occurrence of said selected temperature conditions.

2. A thermally responsive electrical switch comprising an electrically insulating support means, first contact means mounted on the support means, a carrier, spring means mounted on the carrier, second contact means mounted on the spring means to be movable toward and away from the carrier and to be biased toward the carrier by the spring means, and thermally responsive means movable in response to temperature change, the thermally responsive means being mounted on the carrier between the spring means and the carrier to move the second contact means relative to the carrier in response to temperature change, the carrier being disposed in a selected position relative to the support means so that the second contact means move between an open circuit position spaced from the first contact means and a closed circuit position engaged with the first contact means as the second contact means move relative to the carrier in response to the occurrence of selected temperature conditions.

3. A thermally responsive switch as set forth in claim 2 further characterized in that the spring means comprise a spring blade having one end secured to one end of the carrier to dispose an opposite end of the blade to be moved toward and away from an opposite end of the carrier and to be biased toward said opposite end of the carrier, the second contact means is mounted on said opposite end of the spring blade, and the thermally responsive means comprises a dished bimetallic member movable from an original to an inverted dished configuration with snap action in response to the occurrence of selected temperature conditions, said member being disposed between the carrier and the spring blade to hold the second contact means in a first position relative to said opposite end of the carrier against the bias of the spring blade under first temperature conditions and to permit the second contact means to move with snap action to a second position relative to the opposite end of the carrier in response to said bias on the occurrence of said selected temperature conditions.

4. A thermally responsive switch as set forth in claim 3 further characterized in that said support means has locating means thereon, said first contact means are mounted on the support means adjacent to said locating means, and said opposite end of the carrier is disposed in engagement of the locating means to locate the second contact means to be moved between said circuit positions in response to the occurrence of said selected temperature conditions.

5. A thermally responsive switch as set forth in claim 3 further characterized in that an electrically and thermally conductive metal housing part is secured to said electrically insulating support means to form a chamber therebetween, said first contact means are mounted on the electrically insulating support means to extend through the support means from the exterior of the chamber to a location inside the chamber in electrically insulated relation to the electrically conducting housing part, and said carrier is mounted in said chamber in said selected position relative to said electrically insulating support means with said second contact means disposed in electrically conductive relation to said metal housing part and with said thermally responsive member disposed in heat transfer relation to said housing part, said housing part being adapted to be secured in electrically and thermally conducting relation to an object whose temperature is to be monitored.

6. A thermally responsive switch as set forth in claim 3 further characterized in that the carrier has a central recess, said one end of the spring blade is secured to the carrier at one side of the carrier so that the spring blade extends over the recess, and the dished thermally responsive member is disposed between the blade and carrier over the recess for permitting movement of the central part of the dished member into and out of the recess as the member moves between said original and inverted dished configurations in response to temperature change.

7. A thermally responsive switch as set forth in claim 3 further characterized in that a housing part is secured to said electrically insulating support means to form a chamber therebetween, said first contact means are mounted on the electrically insulating support means to extend from the exterior of the chamber into the chamber, said carrier is mounted in said chamber in said selected position relative to said electrically insulating support means, and additional contact means are mounted on said support means to extend from the exterior of the chamber into the chamber in electrically insulated relation to said first contact means, the additional contact means being electrically connected to the second contact means within the chamber.

8. A thermally responsive switch as set forth in claim 2 further characterized in that a pair of the first contact means are mounted on the electrically insulating support means in electrically insulated relation to each other, a pair of the spring means are mounted on the carrier, a pair of the second contact means are mounted on the respective spring means to be movable toward and away from the carrier and to be biased toward the carrier by respective spring means, and a pair of the thermally responsive means are mounted on the carrier between the respective spring means and the carrier to be movable in response to respective temperature changes to hold the respective second contact means away from the carrier against the bias of the respective spring means under respective first temperature conditions and to permit the respective second contact means to move toward the carrier in response to the bias of the respective spring means under respective second temperature conditions, the carrier being mounted in selected position relative to the electrically insulating support means so that said second pair of contact means are moved between open circuit positions spaced from the respective first contact means and closed circuit positions engaged with the respective first contact means in response to the occurrence of said respective selected temperature changes.

9. A thermally responsive switch as set forth in claim 8 further characterized in that the pair of spring means comprise respective spring blades each having one end secured to one end of the carrier to dispose an opposite end of the blade to be moved toward and away from an opposite end of the carrier, the second contact means are mounted on said respective opposite ends of the spring blades, and the thermally responsive means each comprise a dished bimetallic member movable between an original and inverted dished configuration with snap action in response to temperature change, the thermally responsive members being disposed between the carrier and the respective spring blades.

10. A thermally responsive electrical switch comprising a first electrically and thermally conductive metal housing part having an open-ended well therein, a second electrically insulating housing part secured to the first housing part over the open-ended well for forming a chamber between the housing parts, the second housing part having a locating groove therein disposed within the chamber, a pair of first electrically conductive contacts mounted on the second housing part to extend into the chamber from a location outside of the chamber in electrically insulated relation to each other and to the first housing part, a carrier having a central opening, a pair of spring blades each having one end secured to one end of the carrier so that the blades extend over respective opposite sides of the carrier opening, a pair of second contact means mounted on opposite ends of the respective spring blades biased for movement toward each other at an opposite end of the carrier, and a pair of dished, thermally responsive bimetallic members movable between original and inverted dished configurations thereof in response to selected temperature change, the thermally responsive members being disposed on the carrier over the carrier opening between the carrier and the respective spring blades at opposite sides of the carrier opening to move the second contact means as the thermally responsive members move between said original and dished configurations thereof, the carrier having its opposite end disposed in said groove in the second housing part within the chamber to be held in a selected location between the housing parts to move the second contacts between open circuit positions spaced from the respective first contacts and closed circuit positions engaged with respective first contacts in response to said selected temperature changes.

11. A thermally responsive switch as set forth in claim 10 further characterized in that said pair of thermally responsive members are movable to move said respective second contacts between said circuit positions thereof on the occurrence of respective different selected temperature changes.

* * * * *